US009284646B2

(12) United States Patent
Silvain et al.

(10) Patent No.: US 9,284,646 B2
(45) Date of Patent: Mar. 15, 2016

(54) METHOD FOR FORMING A METAL DEPOSIT ON THE SURFACE OF A SUBSTRATE, AND USES THEREOF

(75) Inventors: Jean-Francois Silvain, Cestas (FR); Cecile Vincent, Talence (FR); Jean-Marc Heintz, Saint Morillon (FR)

(73) Assignee: CENTRE NATIONAL DE LA RECHERCHE SCIENTIFIQUE, Paris (FR)

( * ) Notice: Subject to any disclaimer, the term of this patent is extended or adjusted under 35 U.S.C. 154(b) by 288 days.

(21) Appl. No.: 13/807,362

(22) PCT Filed: Jul. 4, 2011

(86) PCT No.: PCT/FR2011/051563

§ 371 (c)(1), (2), (4) Date: Mar. 6, 2013

(87) PCT Pub. No.: WO2012/004501

PCT Pub. Date: Jan. 12, 2012

(65) Prior Publication Data

US 2013/0209679 A1 Aug. 15, 2013

(30) Foreign Application Priority Data

Jul. 5, 2010 (FR) ..... 10 55422

(51) Int. Cl.
*C23C 22/73* (2006.01)
*C23C 26/00* (2006.01)

(52) U.S. Cl.
CPC ..... *C23C 22/73* (2013.01); *C23C 26/00* (2013.01); *B22F 2998/00* (2013.01)

(58) Field of Classification Search
None
See application file for complete search history.

(56) References Cited

U.S. PATENT DOCUMENTS

2002/0187378 A1 12/2002 Hinokuma et al.
2003/0039604 A1 * 2/2003 Niu et al. ..... 423/447.1

(Continued)

OTHER PUBLICATIONS

Reade [Copper oxide powder] <http://www.reade.com/products/35-oxides-metallic-powders/143-cupric-oxide-black-copper-oxide-copperii-oxide-cuo-cas-1317-38-0-cuprous-oxide-red-copper-oxide-brown-copper-oxide-copperi-oxide-cu2o-cas-1317-39-1-> accessed Nov. 26, 2014.*
International Search Report dated Oct. 21, 2011.

(Continued)

*Primary Examiner* — Mandy Louie
(74) *Attorney, Agent, or Firm* — Sofer & Haroun, LLP

(57) ABSTRACT

The present invention relates to a method for forming a metal deposit on the surface of a solid substrate, said method including at least: 1) a step of functionalizing the surface of the substrate by means of —O—P, —O—P—O, —O—S, or —O—S—O groupings; 2) a step of mixing the substrate with metal or metal-oxide particles sublimated at a low temperature; 3) a step of heat-treating the substrate obtained above after step 2), it being understood that said step 3) is only carried out when metal is utilized in the above step 2), said step 3) also being carried out at a temperature that is lower than the temperature for melting the metal in question and further being carried out in the air so as to oxidize said metal; and 4) a step of reducing the metal oxide obtained in step 3) or the metal oxide utilized in step 2) in a reducing atmosphere at a temperature of 0.1 Tf to a temperature that is lower than Tf, Tf being the melting temperature expressed in Kelvin, reducing said metal oxide and concentration sublimating the metal and/or metal oxide, and then bending the metal atoms to the phosphorus atoms of the —O—P groupings, to the sulfur atoms of the O—S groupings, or to the free oxygen atom of the O—P—O or —O—S—O groupings connected to the substrate. The invention also relates to the uses of the method, in particular for preparing reinforcements for powder metallurgy, for casting, or for improving the thermal conductivity of materials.

14 Claims, 6 Drawing Sheets

(56) References Cited

U.S. PATENT DOCUMENTS

| | | | | |
|---|---|---|---|---|
| 2006/0142149 | A1* | 6/2006 | Ma et al. | 502/185 |
| 2009/0068241 | A1* | 3/2009 | Britz et al. | 424/409 |
| 2009/0215953 | A1* | 8/2009 | Hwang et al. | 524/496 |

OTHER PUBLICATIONS

"Extraordinary strengthening effect of carbon nanotubes in metal-matrix nanocomposites processed by molecular-level mixing".
"Novel processing and characterization of Cu/CNF nanocomposite for high thermal conductivity applications".

* cited by examiner

METHOD FOR FORMING A METAL DEPOSIT ON THE SURFACE OF A SUBSTRATE, AND USES THEREOF

RELATED APPLICATIONS

This application is a National Phase Application of PCT/FR2011/051563, filed on Jul. 4, 2011, which in turn claims the benefit of priority from French Patent Application No. 10 55422 filed on Jul. 5, 2010, the entirety of which are incorporated herein by reference.

BACKGROUND

1. Field of the Invention

The present invention relates to a process for depositing metals, and in particular copper, on a substrate.

2. Description of Related Art

The deposition of metals, and in particular of copper, on substrates has an advantage, in particular in the following cases:

- it makes it possible to promote the wetting of the substrates, for example if the latter must be incorporated into a liquid matrix,
- it enables metal-ceramic brazing by pre-metallization of the ceramic,
- it makes it possible to optimize the electrical and/or thermal conductivity of surfaces of insulating materials.

The deposition of metals, and in particular of copper, on substrates can be carried out via various techniques:

i) by physical vapor deposition (PVD): this process consists, for example, in carrying out a sputtering of the metal in a reactor in which the substrate to be coated is placed. The application of a potential difference between the target (cathode) and the walls of the reactor within a rarefied atmosphere enables the creation of a cold plasma. Under the effect of the electric field, the positive species of the plasma are attached by the target and collide with the latter. They then pass on their momentum, thus giving rise to the sputtering of the metal atoms in the form of neutral particles which condense on the substrate in order to form a metallic film thereon. This type of technique is, for example, described in A. Billard and F. Perry, "Pulvérisation cathodique magnetron" [Magnetron sputtering], Techniques de l'Ingénieur, Traité de Matériaux, M 1 654-1.

ii) by chemical vapor deposition (CVD): according to this technique, the substrate is exposed to one or more metal precursors in the gas phase, which react and/or decompose at the surface of the substrate in order to generate the deposit of metal (S. Audisio, "Dépots chimiques à partir d'une phase gazeuse" [Chemical depositions from a gas phase], Techniques de l'Ingénieur, Traité de Matériaux, M 1 660-1). The deposition may be plasma-enhanced.

The PVD and CVD deposition techniques require sophisticated and expensive equipment. Furthermore, they cannot be adapted to any type of support. They also have the drawback of using polluting solvents.

iii) by aqueous chemical deposition: it generally consists in carrying out a redox reaction in an aqueous medium in the presence of a catalyst. The product of the reaction is adsorbed on a substrate in order to form a thin metal film thereon. However, aqueous chemical deposition does not allow a selective deposition of metal on certain zones of the substrate for example. The deposit made is not always sufficiently well fastened to the substrate (simple adsorption).

OBJECTS AND SUMMARY

The objective of the present invention is therefore to provide a simple and inexpensive process for depositing metals, and in particular copper, that makes it possible to produce selective and resistant deposits on any type of substrate. This objective is achieved by the process which will be described below and which is the subject of the present invention.

One subject of the present invention is a process for forming a metal deposit at the surface of a solid substrate, said process being characterized in that it comprises at least:

1) a step of functionalizing at least one portion of the surface of the substrate with —O—P, —O—P—O, —O—S or —O—S—O groups, said groups being bonded to the surface of the substrate by means of an oxygen atom, said functionalization being carried out by bringing the substrate into contact with a phosphating, respectively sulfurizing, agent;

2) a step of mixing the substrate with particles of a metal or of a metal oxide that sublimes at low temperature, either at the same time as the functionalizing step 1), or after said functionalizing step 1);

3) a step of heat treatment of the mixture obtained above at the end of step 2), at a temperature that ranges from 100° C. to 400° C.; it being understood that said step 3) is only carried out when a metal is used in step 2) above, said step 3) additionally being conducted at a temperature below the melting point of the metal in question and in air in order to oxidize said metal and obtain a metal oxide;

4) a step of reduction under a reducing atmosphere, at a temperature between 0.1 $T_m$ and a temperature below $T_m$, $T_m$ being the melting point, expressed in kelvin, of the metal oxide obtained in step 3) or of the metal oxide used in step 2), in order to give rise to the reduction of said metal oxide and the concomitant sublimation of the metal and/or of the metal oxide then the attachment of the metal atoms to the phosphorus atoms of the —O—P groups or to the sulfur atoms of the O—S groups or to the free oxygen atom of the O—P—O or —O—S—O groups bonded to the substrate.

The chemical bonds connecting the oxygen atoms to the surface of the substrate are iono-covalent bonds.

The functionalizing step is a phosphating or sulfurizing step. It is preferably carried out by immersing the substrate in a phosphating agent, respectively a sulfurizing agent, said agents being liquid or in solution in a solvent.

According to the invention, the expression "phosphating agent" is understood to mean any phosphorus-containing compound capable of resulting in the formation of —O—P or —O—P—O— groups at the surface of the substrate. The phosphating agent is preferably chosen from phosphoric acid, phosphoric esters such as the product sold under the trade name Beycostat® C213 by the company Ceca-Gerland, ethyl phosphate or butyl phosphate.

According to the invention, the expression "sulfurizing agent" is understood to mean any sulfur-containing compound capable of resulting in the formation of —O—S or —O—S—O groups at the surface of the substrate. The sulfurizing agent is preferably sulfuric acid.

The solvent of the phosphating or sulfurizing agent is preferably chosen from water, lower alcohols such as ethanol, ketones such as 2-butanone and mixtures thereof.

According to the process in accordance with the invention, the functionalizing step 1) can be carried out over the entire surface of the substrate or else over certain zones only. When one portion only of the surface of the substrate must be functionalized, then the zones on which it is not advisable to attach —O—P, —O—P—O, —O—S or —O—S—O groups are masked prior to the first step. This prior masking step may be carried out by any appropriate technique known to a person skilled in the art, such as for example by applying a mask made of heat-sensitive resin in the case of flat substrates.

The functionalizing step is generally carried out at a temperature below the thermal decomposition temperature of the substrate and preferably at a temperature below the evaporation temperature of the solvent. This functionalizing step is preferably carried out at a temperature ranging from 60° C. to 200° C., and more preferably still from 80° to 100° C.

The duration of the functionalizing step generally ranges from 15 min to 4 hours, and more preferably still from 30 min to 1 hour.

The process in accordance with the invention makes it possible to deposit a metal on any type of solid support. Among the substrates that can be used according to the process of the invention, mention may be made of substrates in the form of powder such as diamond powders and silicon carbide powders, substrates in the form of microfibers and nanofibers such as carbon fibers and alumina fibers, and flat substrates such as substrates made of alumina, carbon or silicon.

According to one particular embodiment of the process of the invention, and when the functionalizing step and the step of mixing the substrate with the particles of metal or metal oxide are carried out separately, the process can then additionally comprise, after the step of functionalizing the substrate, a step of drying the substrate. This drying step is preferably carried out in an oven, at a temperature ranging from 80° to 120° C. approximately.

For the purposes of the present invention, the expression "metal or metal oxide that sublimes at low temperature" is understood to mean the metals or metal oxides that sublime at a temperature T less than or equal to 0.5 $T_m$, $T_m$ being the melting point, expressed in kelvin, of the metal or of the metal oxide in question.

According to the invention, the metals and metal oxides that sublime at low temperature are preferably chosen from metals and metal oxides that sublime at a temperature generally below 1000° C., and more particularly still below 500° C.

The metals that sublime at low temperature are preferably chosen from copper (sublimation temperature (ST=727° C.), lead (ST=342° C.), nickel and magnesium, these sublimation temperatures being given for a vapor pressure in the external environment of around $10^{-8}$ Torr.

The metal oxides that sublime at low temperature may be chosen from dendritic copper oxide (ST=starting from 250° C.), lead oxide (ST=starting from 200° C.) and nickel oxide (ST=starting from 300° C.), these sublimation temperatures being given for a vapor pressure in the external environment of around $10^{-8}$ Torr.

The particles of metal or metal oxide used during the second step preferably have a size that ranges from 10 nm to 100 μm and more preferably still from 100 nm to 50 μm.

Step 2) of mixing the substrate with the particles of metal or metal oxide may, for example, be carried out in a powder mixer (when it is a question of substrates in the form of powder or fibers, such as for example a rotary mixer) or else by covering the substrate with a layer of particles of metal or metal oxide (in the case of flat substrates).

Of course, the temperature at which the mixing of the substrate with the particles of metal or metal oxide is carried out is not critical and may vary as a function of the nature of the metal or of the metal oxide used, between ambient temperature and 250° C.

The duration of step 2) of mixing the substrate with the particles may range from 30 min to 2 hours, and more preferably still the duration of this mixing step is around 1 hour.

According to one preferred embodiment of the invention, the heat treatment step 3) is carried out at a temperature ranging from 200° C. to 400° C., it being understood that this temperature is chosen as a function of the nature of the metal to be oxidized, so that within this temperature range it is below the melting point of the metal in question. This heat treatment step makes it possible to oxidize the metal when a metal is used in step 2) of mixing the substrate with the particles of metal, but also to thermally decompose the organic species originating from the phosphating or sulfurizing agent and from the solvent when a solvent is used.

The reduction step 4) (also referred to as "deoxidation step") may for example be carried out by exposing the substrate to an argon atmosphere containing 5 vol % of hydrogen for a duration ranging from 1 to 2 hours.

The reduction step 4) is preferably carried out at a temperature ranging from 200° C. to 700° C. This step makes it possible to reduce the metal oxide and/or to sublime the metal oxide and/or the metal in order to enable the condensation of the metal atoms on the phosphorus, sulfur or oxygen atoms of the —O—P, —O—P—O, —O—S or —O—S—O groups (nucleation sites). It is important to note that during the various steps of the process in accordance with the invention, the particles of metal or metal oxide used never pass into the liquid state. The nanometric size of these particles means that during step 4), the metal oxide or the metal in question may sublime at a temperature below its theoretical sublimation temperature, this is why the temperatures recommended for carrying out step 4) may be below the sublimation temperature of the metal or metal oxide in question but may nevertheless be sufficient to give rise to its sublimation.

The material obtained in accordance with the invention is a composite material consisting of a substrate comprising a metal deposit.

When the material obtained at the end of the process in accordance with the invention is a material in the form of powder (powdered substrate comprising a metal, in particular copper, coating), this material can then be densified, for example by hot uniaxial pressing (650° C., 15 bar, 20 min, under vacuum).

Another subject of the invention is the uses of the process in accordance with the invention and as described previously, and in particular for:

the preparation of reinforcements for powder metallurgy, the preparation of reinforcements for casting, improving the thermal conductivity of materials.

The present invention is illustrated by the following exemplary embodiments, to which it is not however limited.

DETAILED DESCRIPTION

Examples

Figure 1:
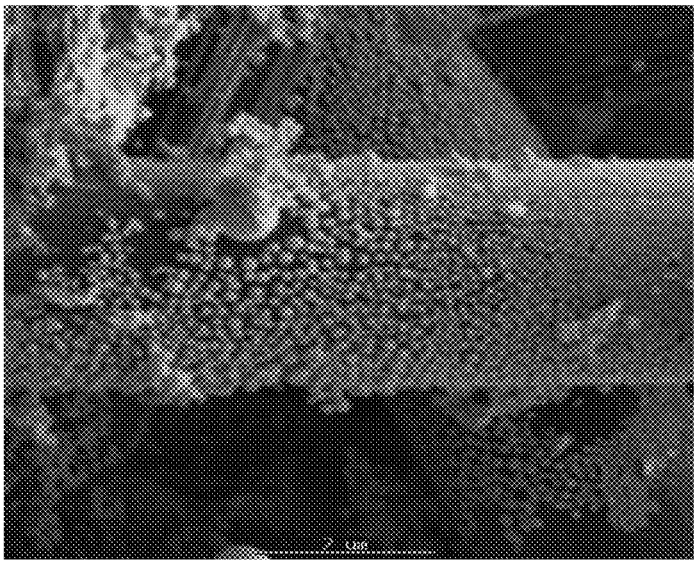
FIG. 1 is a scanning electron microscopy photograph of carbon fibers after the deposition of copper (magnification× 10 000) in accordance with one embodiment described in example 1.

The raw materials used in the following examples are listed below:

- Milled micrometric carbon fibers (CFs) having a diameter of 10 μm approximately, sold under the trade names K223HG, XN100 and CN80C by the company Mitsubishi, their length being between 30 and 300 μm and more specifically around 10 μm;
- Nanometric carbon fibers (CFs) having a diameter of approximately 150 nm, and a length which may range up to about 10 microns, sold under the trade name VGCNF by the company Showa Denko;
- Alumina fibers having a diameter of approximately 10 μm sold under the trade name Alumina Short Fibers by the company Saffil;
- Silicon carbide particles sold under the trade name LS5 by the company Lonza;
- Diamond powder sold under the trade name MBD4, MBD6 or MBD8 by the company Henan Zhongxin Industry;
- Silicon substrate sold under the trade name Wafer Si monocrystalline by the company Prolog Semicor;
- Micron-sized powder of dendritic copper sold under the trade name CHL10 by the company Ecka Granules Poudmet;
- Micron-sized powder of oxidized lead sold under the trade name Lead Powder 200 Mesh by the company Alfa Aesar;
- Phosphoric ester sold under the trade name Beycostat® C213 by the company Ceca-Gerland;
- 85% by weight aqueous solution of orthophosphoric acid sold by the company Acros Organics;
- 20% by weight aqueous solution of sulfuric acid sold by the company J.T. Baker;
- Solvents: ethanol; butanone; (companies Acros Organics or Fisher Bioblock)

These raw materials were used as received from their manufacturers, without additional purification.

Example 1

Deposition of Copper on Micrometric Carbon Fibers

In this example, copper was deposited on carbon microfibers using a phosphoric ester as phosphating agent.

1) First Step: Functionalization of the Substrate (Phosphation) and Simultaneous Mixing of the Substrate with Copper 4.29 g of dendritic copper, 0.71 g of K223HG carbon microfibers, 3.5 mL of an ethanol/butanone (1:2; v/v) mixture and 0.025 g of Beycostat® C213 were mixed using a planetary mixer for around 4 h at ambient temperature.

2) Second Step: Oxidation of the Copper

The resulting mixture was then brought to a temperature of 400° C. for 1 hour in air in order to give rise to the oxidation of the dendritic copper and the thermal decomposition of all the organic species.

3) Third Step: Deposition of Copper on to the Substrate

The resulting oxidized mixture was deoxidized under an $Ar/H_2$ reducing atmosphere for 1 hour at 400° C. in order to give rise to the conversion of the copper oxide to metallic copper and also the concomitant sublimation of the copper oxide and/or of the metallic copper then the attachment of the metallic copper to the substrate in preparation for a future (hot-pressing type) forming operation.

The appended FIG. 1 is a scanning electron microscopy photograph of carbon fibers after the deposition of copper (magnification×10 000).

Example 2

Deposition of Copper on Micrometric Carbon Fibers

In this example, copper was deposited on carbon microfibers using orthophosphoric acid as phosphating agent.

1) First Step: Functionalization of the Substrate (Phosphation)

710 mg of carbon microfibers were immersed in 2 mL of orthophosphoric acid ($H_3PO_4$) diluted in distilled water (1:3, v/v) for 20 min at 80° C. under magnetic stirring.

The carbon fibers were then rinsed with distilled water and then dried.

2) Second Step: Mixing of the Functionalized Substrate with the Oxidized Dendritic Copper The functionalized carbon microfibers were then mixed in a planetary mixer, at ambient temperature, for around 4 hours, with 6.62 g of micron-sized dendritic copper powder previously oxidized by calcination in air for around 1 hour at 400° C.

3) Third Step: Deposition of Copper

The resulting mixture was then brought to a temperature of 400° C. under an $Ar/H_2$ reducing atmosphere for 1 hour at 400° C.

Figure 2:
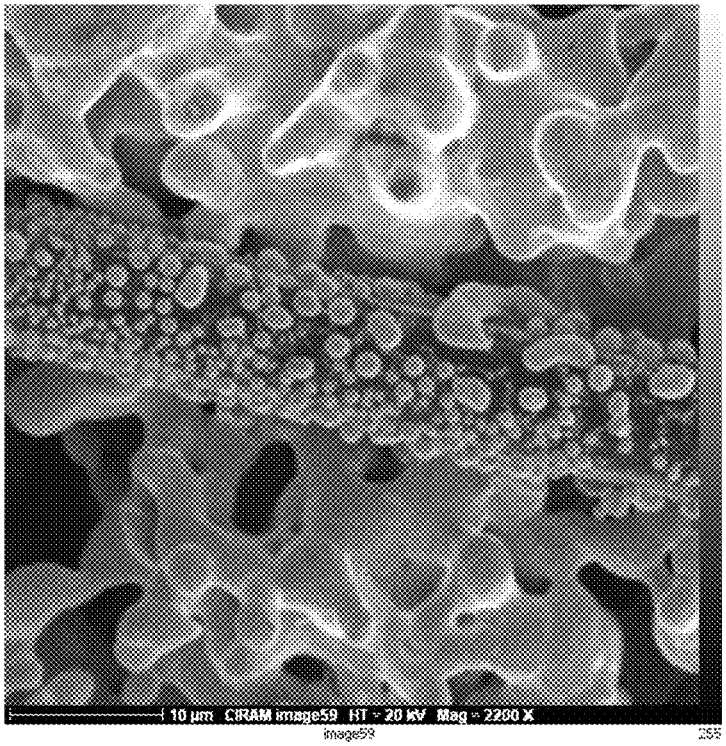
FIG. 2 is a scanning electron microscopy photograph of the carbon fibers after the deposition of copper (magnification× 2200) in accordance with one embodiment described in example 2.

The appended FIG. 2 is a scanning electron microscopy photograph of the carbon fibers after the deposition of copper (magnification×2200).

Example 3

Deposition of Lead on Carbon Fibers

In this example, lead was deposited on carbon microfibers using orthophosphoric acid as phosphating agent.

1) First Step: Functionalization of the Substrate (Phosphation)

710 mg of K223HG carbon microfibers were immersed in 2 mL of orthophosphoric acid ($H_3PO_4$) diluted in distilled water (1:3, v/v) for 20 min at 80° C. under magnetic stirring.

The carbon fibers were then rinsed with distilled water and then dried.

2) Second Step: Mixing of the Functionalized Substrate with the Particles of Oxidized Lead The functionalized carbon microfibers were then mixed in a planetary mixer for around 4 hours at ambient temperature with 4.29 g of micron-sized powder of oxidized lead.

3) Third Step: Deposition of Lead

The resulting mixture was then deoxidized under an $Ar/H_2$ reducing atmosphere for 1 hour at 400° C.

Figure 3:
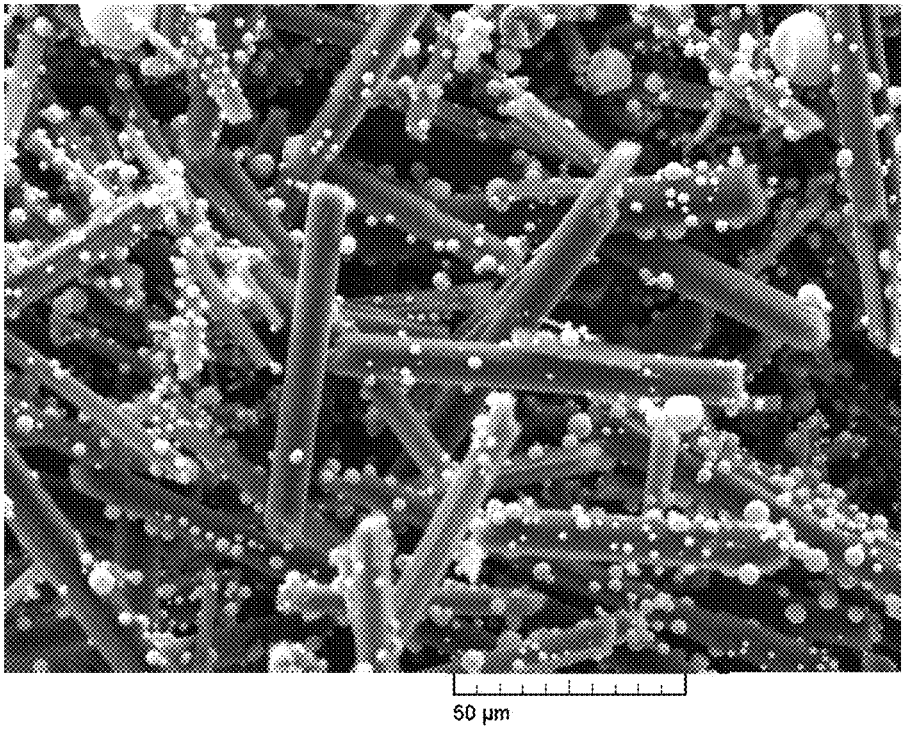
FIG. 3 is a scanning electron microscopy photograph of the carbon fibers after the deposition of lead (magnification× 1120) in accordance with one embodiment described in example 3.

The appended FIG. 3 is a scanning electron microscopy photograph of the carbon fibers after the deposition of lead (magnification×1120).

Example 4

Deposition of Copper on Alumina Fibers

In this example, copper was deposited on alumina fibers using a phosphoric ester as phosphating agent.

1) First Step: Functionalization of the Substrate and Simultaneous Mixing of the Substrate with Copper 4.29 g of dendritic copper, 710 mg of alumina microfibers, 3.5 mL of an ethanol/butanone (1:2; v/v) mixture and 0.2 g of Beycostat® C213 were mixed using a planetary mixer for around 4 h at ambient temperature.

2) Second Step: Oxidation of the Copper

The resulting mixture was then brought to a temperature of 400° C. for 1 hour in air.

3) Third Step: Deposition of Copper

The resulting oxidized mixture was deoxidized under an $Ar/H_2$ reducing atmosphere for 1 hour at 400° C.

Figure 4:
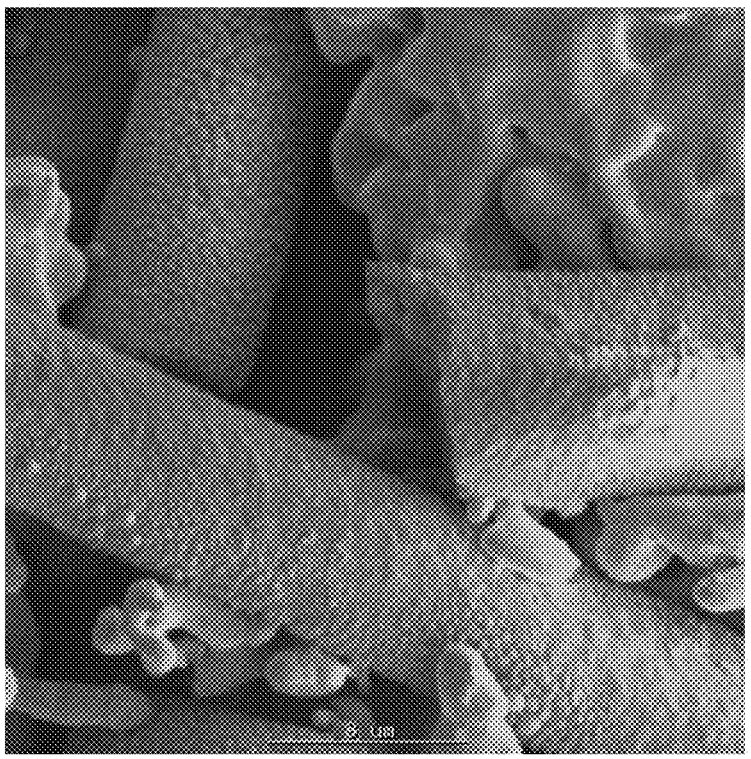
FIG. 4 is a scanning electron microscopy photograph of alumina fibers after the deposition of copper (magnification× 5000) in accordance with one embodiment described in example 4.

The appended FIG. 4 is a scanning electron microscopy photograph of alumina fibers after the deposition of copper (magnification×5000).

Example 5

Deposition of Copper on a Silicon Carbide Substrate

In this example, copper was deposited on silicon carbide substrate using a phosphoric ester as phosphating agent.

1) First Step: Functionalization of the Substrate and Simultaneous Mixing of the Substrate with Copper 4.29 g of dendritic copper, 710 mg of silicon carbide powder, 3.5 mL of an ethanol/butanone (1:2; v/v) mixture and 0.2 g of Beycostat® C213 were mixed using a planetary mixer for around 4 h at ambient temperature.

2) Second Step: Oxidation of the Copper

The resulting mixture was then brought to a temperature of 400° C. for 1 hour in air.

3) Third Step: Deposition of Copper

The resulting oxidized mixture was deoxidized under an $Ar/H_2$ reducing atmosphere for 1 hour at 400° C.

Figure 5:
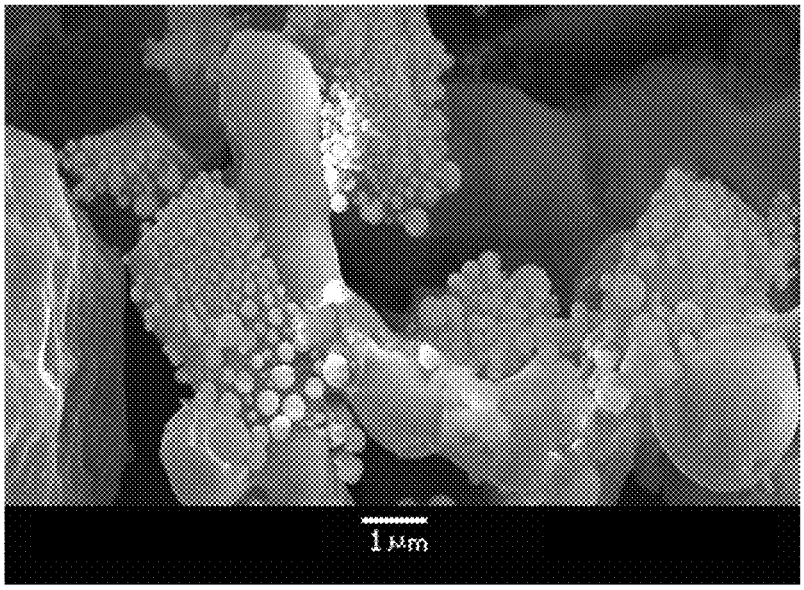
FIG. 5 is a scanning electron microscopy photograph of the substrate after the deposition of copper (magnification×10 000) in accordance with one embodiment described in example 5.

The appended FIG. 5 is a scanning electron microscopy photograph of the substrate after the deposition of copper (magnification×10 000).

Example 6

Deposition of Copper on Diamond Powder

In this example, copper was deposited on diamond powder using a phosphoric ester as phosphating agent.

1) First Step: Functionalization of the Substrate and Simultaneous Mixing of the Substrate with Copper 4.29 g of dendritic copper, 710 mg of diamond powder, 3.5 mL of an ethanol/butanone (1:2; v/v) mixture and 0.2 g of Beycostat® C 213 were mixed using a planetary mixer for around 4 h at ambient temperature.

2) Second Step: Oxidation of the Copper

The resulting mixture was then brought to a temperature of 400® C. for 1 hour in air.

3) Third Step: Deposition of Copper

The resulting oxidized mixture was deoxidized under an $Ar/H_2$ reducing atmosphere for 1 hour at 400° C.

Figure 6:
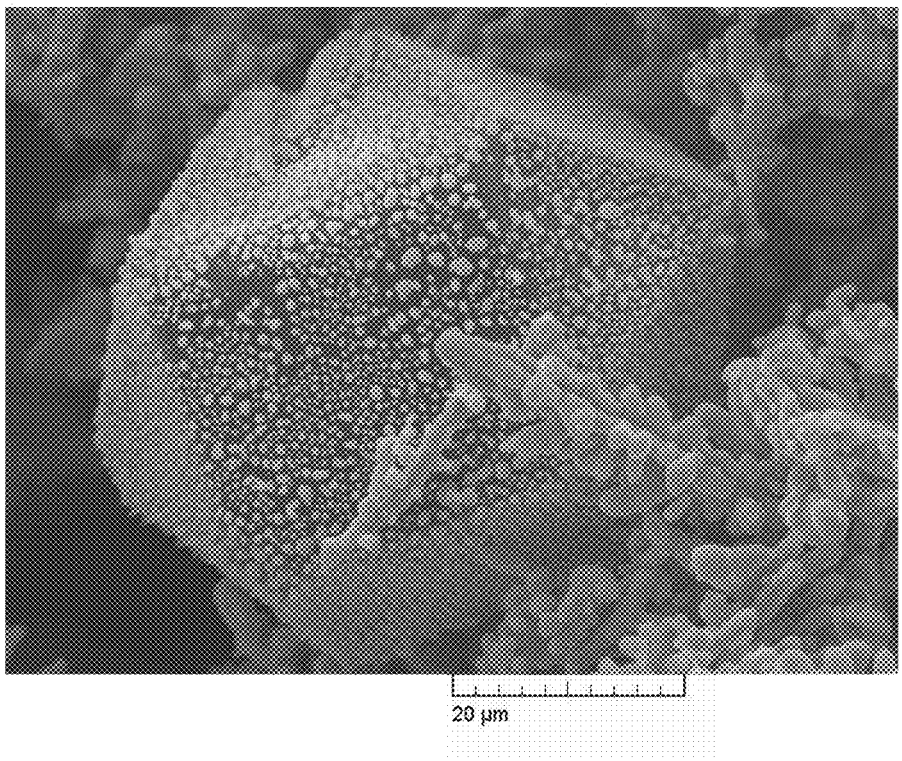
FIG. 6 is a scanning electron microscopy photograph of diamond powder after the deposition of copper (magnification×2800) in accordance with one embodiment described in example 6.

The appended FIG. 6 is a scanning electron microscopy photograph of diamond powder after the deposition of copper (magnification×2800).

Example 7

Deposition of Copper on a Silicon Substrate

In this example, copper was deposited on a silicon substrate using a phosphoric ester as phosphating agent.

1) First Step: Functionalization of the Substrate and Simultaneous Mixing of the Substrate with Copper 4.29 g of dendritic copper, the silicon substrate (dimensions: approximately 1 cm×1 cm), 3.5 mL of an ethanol/ butanone (1:2; v/v) mixture and 0.2 g of Beycostat® C 213 were mixed using a planetary mixer for around 4 h at ambient temperature.

2) Second Step: Oxidation of the Copper

The resulting mixture was then brought to a temperature of 400® C. for 1 hour in air.

3) Third Step: Deposition of Copper

The resulting oxidized mixture was deoxidized under an $Ar/H_2$ reducing atmosphere for 1 hour at 400° C.

Figure 7:
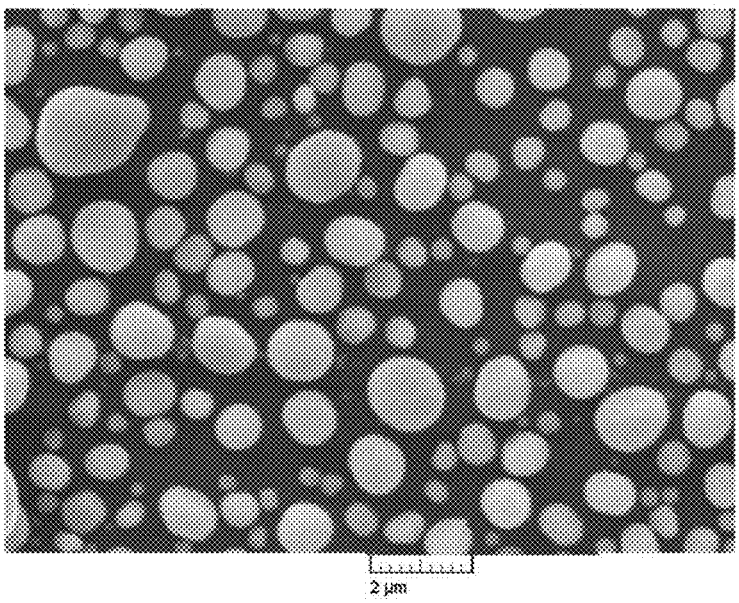
FIG. 7 is a scanning electron microscopy photograph of the silicon substrate after the deposition of copper (magnification×15 170) in accordance with one embodiment described in example 7.

The appended FIG. 7 is a scanning electron microscopy photograph of the silicon substrate after the deposition of copper (magnification×15 170).

Example 8

Study of the Thermal Conductivity and of the Density of a Copper/Diamond Composite Material The copper/diamond composite material was prepared by hot uniaxial pressing (650° C., 15 bar, 20 min, under vacuum) of the diamond powder prepared above in example 6.

The thermal conductivity of the copper/diamond composite produced by this technique then densified by hot uniaxial pressing (650° C., 15 bar, 20 min, under vacuum) was then measured with a laser flash analyzer sold under the trade name LFA 457 MicroFlash® by the company Netzsch.

It was found to be greater than that obtained for a conventional comparative alloyed copper/diamond composite prepared by simple mechanical mixing of the diamond powder and copper and densified by hot uniaxial pressing under the same conditions for a same volume fraction: 485 W/m·K (copper/diamond composite in accordance with the invention) >400 W/m·K (comparative copper/diamond composite that is not part of the invention).

Furthermore, other copper/diamond (Cu/D) composites were prepared under the same conditions as those described above in example 6 with MBD6 diamond powder, by varying the volume fraction of the diamond powder with respect to the copper (10%, 20%, 30% and 40%) for the purpose of studying the effect of this variation on the density, the thermal conductivity (measured by the LFA 457 MicroFlash® analyzer) and the thermal coefficient (measured using a horizontal dilatometer sold under the reference DIL 402C by the company Netzsch) of the corresponding materials, after hot uniaxial pressing.

Figure 8:
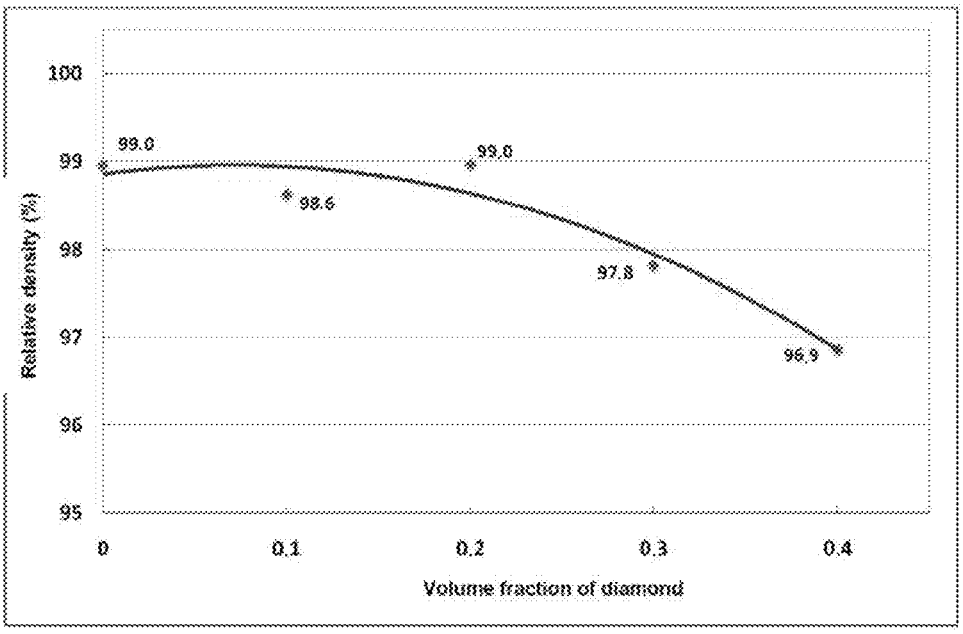
FIG. 8 is graph representing the change in the relative densities (in %) of the various Cu/D composites as a function of the volume fraction of diamond in accordance with one embodiment described in example 8.
Figure 9:
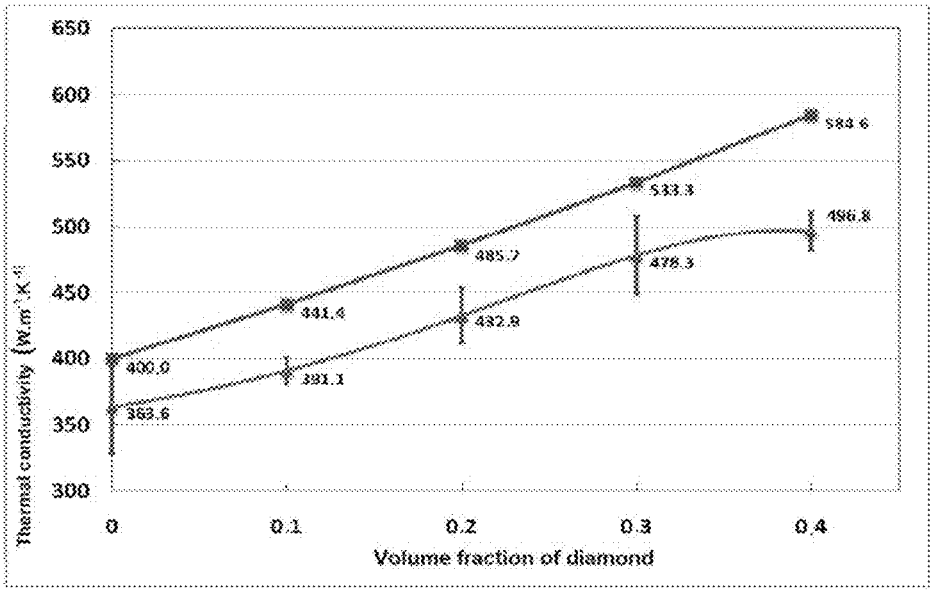
FIG. 9 is graph representing the change in the thermal conductivity (in $W \cdot m^{-1} \cdot K^{-1}$) as a function of the volume fraction of diamond, in accordance with one embodiment described in example 8.
Figure 10:
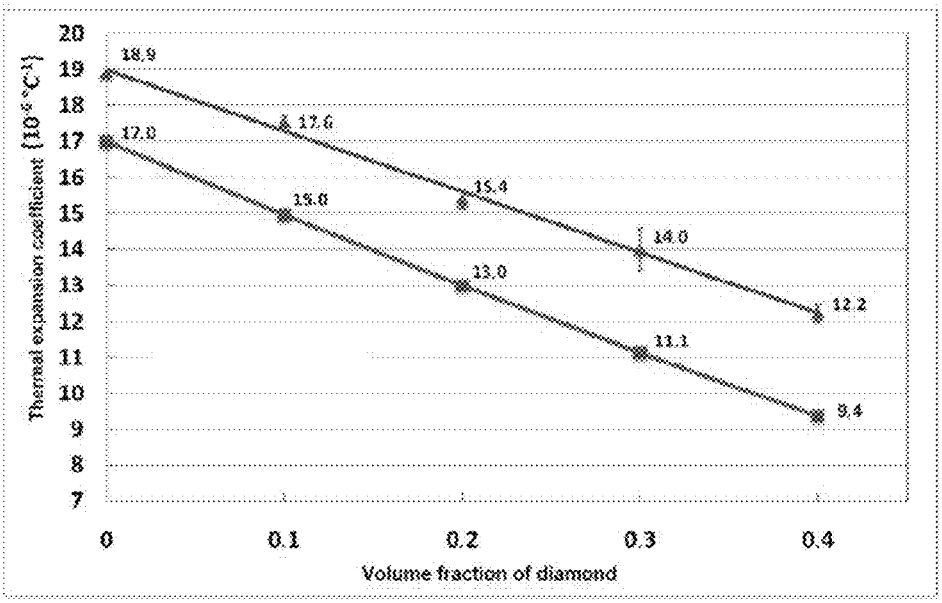
FIG. 10 is a graph representing the change in the thermal expansion coefficient ($10^{-6}$° $C.^{-1}$) as a function of the volume fraction of diamond, in accordance with one embodiment described in example 8.

The results are represented in the appended FIGS. 8, 9 and 10.

FIG. 8 represents the change in the relative densities (in %) of the various Cu/D composites as a function of the volume fraction of diamond.

FIG. 9 represents the change in the thermal conductivity (in $W \cdot m^{-1}, K^{-1}$) as a function of the volume fraction of diamond, the curve for which the points are solid squares corresponding to the predictive model by Maxwell (Maxwell J C. A Treatise on Electricity and Magnetism; Oxford University Press, 1873) and the curve for which the points are solid triangles corresponding to the experimental data.

FIG. 10 represents the change in the thermal expansion coefficient ($10^{-6}$° $C.^{-1}$) as a function of the volume fraction of diamond; the curve for which the points are solid squares corresponds to the predictive model by Kerner (Kerner E H., The elastic and thermo-plastic properties of composite media, Proc. of the Physical Society of London, 1956, 69 (8), 808-813) and the curve for which the points are solid triangles corresponds to the experimental data.

The results from FIG. 8 show that the process for depositing copper on the functionalized diamond particles makes it possible to obtain dense composite materials, with relative densities between 97% and 100%), which proves the effectiveness of the copper deposit as a chemical bonding agent between the matrix and the reinforcements.

The results from FIG. 9 show that the thermal conductivities increase with the percentage of reinforcement (diamond powder) and follow the theoretical trend.

The results from FIG. 10 show that the decrease in the thermal expansion coefficient is inversely proportional to the volume fraction of diamond ($12 \times 10^{-6}$° $C.^{-1}$) and follow the theoretical trend.

Example 9

Deposition of Copper on Carbon Fibers

In this example, copper was deposited on carbon microfibers using sulfuric acid as sulfurizing agent.

1) First Step: Functionalization of the Substrate (Sulfuration)

700 mg of K223HG carbon microfibers were immersed in 100 mL of sulfuric acid ($H_2SO_4$) at 20% by weight in distilled water for 30 min at 80° C. under magnetic stirring.

The carbon fibers were then rinsed with distilled water and then dried.

2) Second Step: Mixing of the Functionalized Substrate with Dendritic Copper

The functionalized carbon microfibers were then mixed in a planetary mixer, at ambient temperature, for around 4 hours with 4.5 g of micron-sized copper powder.

3) Third Step: Oxidation of the Copper

The resulting mixture was then brought to a temperature of 400° C. for 2 hours in air in order to give rise to the oxidation of the copper.

4) Fourth Step: Deposition of the Copper on the Substrate

The resulting oxidized mixture was deoxidized under an $Ar/H_2$ reducing atmosphere for 2 hours at 400° C.

Figure 11:
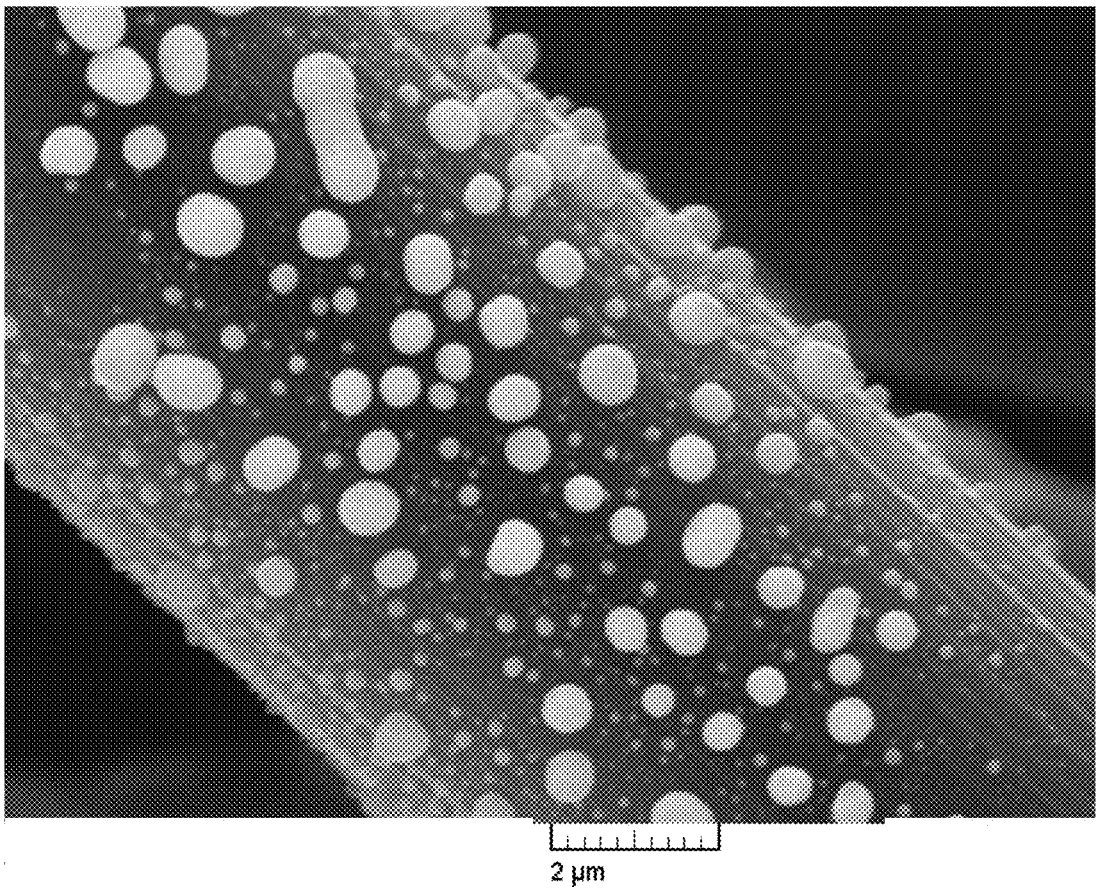
FIG. 11 is a scanning electron microscopy photograph of the carbon fibers after the deposition of copper, in accordance with one embodiment described in example 9.

The appended FIG. 11 is a scanning electron microscopy photograph of the carbon fibers after the deposition of copper.

The invention claimed is:

1. A process for forming a metal deposit at the surface of a solid substrate, said process comprising the steps of:

a) a step of functionalizing at least one portion of the surface of the substrate with —O—P, —O—P—O, —O—S or —O—S—O groups, said groups being bonded to the surface of the substrate by means of an oxygen atom, said functionalization being carried out by bringing the substrate into contact with either one of a phosphating or sulfurizing agent respectively;

b) a step of mixing the substrate with particles of a metal or of a metal oxide that sublimes at temperature below 1000° C., said particles having a size that ranges from 10 nm to 100 μm, either one of at the same time as the functionalizing step a), or after said functionalizing step;

c) a step of heat treatment of the mixture obtained above at the end of step b), at a temperature that ranges from 100° C. to 400° C.; it being understood that said step c) is only carried out when a metal is used in step b) above, said step c) additionally being conducted at a temperature below the melting point of the metal in question and in air in order to oxidize said metal and obtain a metal oxide;

d) a step of reduction under a reducing atmosphere and of concomitant sublimation, at a temperature between 0.1 $T_m$ and a temperature below $T_m$, $T_m$ being the melting point, expressed in Kelvin, of the metal oxide obtained in step c) or of the metal oxide used in step b), in order to give rise to the reduction of said metal oxide and concomitant condensation of the metal atoms on the phosphorus atoms of the —O—P groups or on the sulfur atoms of the O—S groups or on the free oxygen atom of the O—P—O or —O—S—O groups bonded to the substrate.

2. The process as claimed in claim 1, wherein the functionalizing step is carried out by immersing the substrate in either one of a phosphating or sulfurizing agent, said agents being either one of liquid or in solution in a solvent.

3. The process as claimed in claim 1, wherein the phosphating agent is selected from the group consisting of phosphoric acid, phosphoric esters, ethyl phosphate and butyl phosphate.

4. The process as claimed in claim 1, wherein the sulfurizing agent is sulfuric acid.

5. The process as claimed in claim 1, wherein the functionalizing step is carried out at a temperature that ranges from 60° C. to 200° C.

6. The process as claimed in claim 1, wherein the duration of the functionalizing step ranges from 15 minutes to 4 hours.

7. The process as claimed in claim 1, wherein the substrate is selected from the group consisting of substrates in the form of powder, of microfibers and of nanofibers and flat substrates.

8. The process as claimed in claim 1, wherein the metals that sublime are selected from the group consisting of copper, lead, nickel and magnesium.

9. The process as claimed in claim 1, wherein the metal oxides are selected from the group consisting of dendritic copper oxide, lead oxide and nickel oxide.

10. The process as claimed in claim 1, wherein the reducing step d) is carried out by exposure of the substrate to an argon atmosphere containing 5 vol % of hydrogen for a duration ranging from 1 to 2 hours.

11. The process as claimed in claim 1, wherein the reducing step is carried out at a temperature that ranges from 200° C. to 700° C.

12. The process as claimed in claim 1, further comprising a step of preparing reinforcements for powder metallurgy or for casting.

13. The process as claimed in claim 1, further comprising a step of improving the thermal conductivity of materials.

14. The process as claimed in claim 1, wherein the particles of metal or of metal oxide used during the second step have a size that ranges from 100 nm to 50 μm.

* * * * *